US005785191A

United States Patent [19]

Feddema et al.

[11] Patent Number: 5,785,191

[45] Date of Patent: Jul. 28, 1998

[54] OPERATOR CONTROL SYSTEMS AND METHODS FOR SWING-FREE GANTRY-STYLE CRANES

[75] Inventors: John T. Feddema; Ben J. Petterson; Rush D. Robinett, III, all of Albuquerque, N. Mex.

[73] Assignee: Sandia Corporation, Albuquerque, N. Mex.

[21] Appl. No.: 651,166

[22] Filed: May 15, 1996

[51] Int. Cl.[6] ..... B66C 13/06

[52] U.S. Cl. ..... 212/275

[58] Field of Search ..... 212/275; 340/685

[56] References Cited

U.S. PATENT DOCUMENTS

| | | | |
|---|---|---|---|
| 3,517,830 | 6/1970 | Virkkala et al. | 212/132 |
| 3,921,818 | 11/1975 | Yamagishi et al. | 212/132 |
| 4,512,711 | 4/1985 | Ling et al. | 414/786 |
| 4,603,783 | 8/1986 | Tax et al. | 212/132 |
| 4,717,029 | 1/1988 | Yasunobu et al. | 212/132 |
| 4,756,432 | 7/1988 | Kawashima et al. | 212/132 |
| 4,916,635 | 4/1990 | Singer et al. | 364/513 |
| 4,997,095 | 3/1991 | Jones et al. | 212/147 |
| 5,127,533 | 7/1992 | Virkkunen | 212/147 |
| 5,219,420 | 6/1993 | Kiiski et al. | 212/147 |
| 5,443,566 | 8/1995 | Rushmer et al. | 212/275 |
| 5,495,955 | 3/1996 | Shibata | 212/275 |
| 5,642,822 | 7/1997 | Monzen et al. | 212/275 |

OTHER PUBLICATIONS

G. R. Elliott, R. J. Fogler, N. Ahmed and D. Hush, *On a Second-Order Adaptive Infinite Impulse Response Filter*, SAND83-2298C, Sandia National Laboratories, Albuquerque, NM (1983).

J. W. Auernig and H. Troger, *Time Optimal Control of Overhead Cranes and Hoisting of the Load*, Automatica, vol. 23, No. 4, pp. 437–447 (1987).

Kamal A. F. Moustafa and Am M. Ebeid, *Nonlinear Modeling and Control of Overhead Crane and Load Sway*, Journal of Dynamic Systems, Measurement, and Control, vol. 110, pp. 266–271 (1988).

N. C. Singer, *Residual Vibration Reduction in Computer Controlled Machines*, Technical Report AI-TR 1030, MIT Artificial Intelligence Laboratory, Cabridge, MA (Jan. 1989).

A. D. Christian, *Design Implementation of a Flexible Robot*, Technical Report AI-TR 1153, MIT Artificial Intelligence Laboratory, Cambridge, MA (Aug. 1989).

Eduardo Bayo, Philip Papadopoulos, James Stubbe, and Miguel Angel Serna, *Inverse Dynamics and Kinematics of Multi-Link Elastic Robots: An Iterative Frequency Domain Approach*, The International Journal of Robotics Research, vol. 8, No. 6, pp. 49–62 (Dec. 1989).

(List continued on next page.)

*Primary Examiner*—Thomas J. Brahan

*Attorney, Agent, or Firm*—Andrew A. Abeyta; George H. Libman

[57] ABSTRACT

A system and method for eliminating swing motions in gantry-style cranes while subject to operator control is presented. The present invention comprises an infinite impulse response ("IIR") filter and a proportional-integral ("PI") feedback controller (50). The IIR filter receives input signals (46) (commanded velocity or acceleration) from an operator input device (45) and transforms them into output signals (47) in such a fashion that the resulting motion is swing free (i.e., end-point swinging prevented). The parameters of the IIR filter are updated in real time using measurements from a hoist cable length encoder (25). The PI feedback controller compensates for modeling errors and external disturbances, such as wind or perturbations caused by collision with objects. The PI feedback controller operates on cable swing angle measurements provided by a cable angle sensor (27). The present invention adjusts acceleration and deceleration to eliminate oscillations. An especially important feature of the present invention is that it compensates for variable-length cable motions from multiple cables attached to a suspended payload.

27 Claims, 7 Drawing Sheets

OTHER PUBLICATIONS

Farshad Khorrami, *Analysis of Multi–link Flexible Manipulators Via Asymptotic Expansions,* Proceedings of the 28th IEEE Conference on Decision and Control, Tampa, FL, pp. 2089–2094 (Dec. 1989).

Stephen Yurkovich, Anthony P. Tzes, Iewen Lee and Kenneth Hillsley, *Control and System Identification of a Two–Link Flexible Manipulator,* Proceedings of the 1990 IEEE International Conference on Robotics and Automation, Cincinnati, OH, pp. 1626–1631 (May 13–19, 1990).

Brett R. Murphy and Ichiro Watanabe, *Digital Shaping Filters for Reducing Machine Vibration,* IEEE Transactions on Robotics snd Automation, vol. 8, No. 2, pp. 285–289 (Apr. 1991).

John T. Feddema et al, *Techniques for Controlling a Two–Link Flexible Arm,* Proceedings of Fourth topical Meeting on Robotics and Remote Systems, Albuquerque, NM (Feb. 24–28, 1991).

M. Fliess, J. Levine, and P. Rouchon, *A Simplified Approach of Crane Control Via a Generalized State–Space Model,* IEEE Proceedings of the 30$^{th}$ Conference on Decision and Control, Brighton, England, pp. 736–741 (1991).

A. M. Ebeid, Mamal A. F. Moustafa, and H. E. Emara–Shabaik, *Electromechanical Modelling of Overhead Cranes,* International J. Of Systems Science, vol. 23, No. 12, pp. 2155–2169 (1992).

H. T. Nguyen, *State–Variable Feedback Controller for an Overhead Crane,* Journal of Electrical and Electronics Engineering, Austrailia, vol. 14, No. 2, pp. 75–84 (Jun. 1994).

OPERATOR CONTROL SYSTEMS AND METHODS FOR SWING-FREE GANTRY-STYLE CRANES

I. GOVERNMENT RIGHTS

This invention was made with United States Government support under Contract No. DE-AC04-94AL85000 awarded by the U.S. Department of Energy. The Government has certain rights in this invention.

II. BACKGROUND OF THE INVENTION

The present invention relates generally to the field of cranes. More specifically, the present invention relates to methods and systems for eliminating residual oscillation of suspended payloads of gantry-style cranes.

In general, construction and transportation cranes can be grouped into one of two categories based on their configuration. The first category is overhead gantry-style crane systems, which incorporate a trolley that translates in a horizontal plane. Attached to the trolley is a load-line for payload attachment. Typically, gantry-style crane systems have varying load-line length capabilities. The second category is rotary crane systems, for which the load-line attachment point undergoes rotation. Other degrees of freedom may exist such as translation of the load-line attachment point along the jib, variable load-line length, or if the jib is replaced by a boom, the characteristic boom rotational motion, known as luffing.

During overhead gantry-style crane transportation, a payload is free to swing in a pendulum-like motion. If the payload oscillates during crane transportation, then the oscillation must be damped sufficiently by the crane operator or be allowed to decay naturally before the next operation begins. Either option is costly, time consuming, and reduces facility availability, which could lead to larger receiving facility and cask fleet size. If the crane system can be automated with a programmable computer, however, oscillation of the payload can be eliminated by reacting to the forces created by the pendulum-like motion associated with movement of the payload. In addition, programmability allows movement of suspended objects that are initially at rest without introduction of payload oscillation. Thus, cost, time, and facility and cask fleet requirements can be minimized.

Currently, most industrial cranes do not automatically compensate for suspended payload swing at the end of a motion. The crane operator relies on experience to bring the payload to a swing-free stop. Failure of the operator to successfully stop the payload from swinging causes a decrease in operating efficiency because the heavy spreader that typically is suspended from a crane cannot be safely connected to a container if the spreader is moving. Similarly, a container cannot be safely placed at a stationary position if the payload (spreader and container combined) is moving.

Those industrial cranes that automatically compensate for suspended payload swing at the end of a motion typically work only for pre-planned motions where the desired start and end positions of the payload in crane coordinates are well specified. The acceleration and constant velocity times of the motion profiles are planned so that they are a function of the natural period of oscillation $\tau$ of the pendulum-like motion associated with movement of the payload.

Unfortunately, cranes are used most often in unstructured environments, such as in ship yards and factory floors, where the end position in crane coordinates is not well specified. For example, the desired position of a payload on a ship is not well specified because placement of payloads on ships is not uniform. Therefore, most cranes are guided to their final destination by an operator with the aid of an operator input device, such as a joystick.

The field is replete with crane control systems that attempt to eliminate payload swing. Examples of some swing-free crane-related patents are the following:

U.S. Pat. No. 5,443,566, Electronic Antisway Control, of Rushmer et al. depicts a system for the electronic control of the sway of a suspended load from a crane. The natural frequency $\omega_n$ of a simple pendulum is used to estimate the velocity and displacement of the suspended load, and a signal representative of measured load displacement is used to drive the estimated load displacement to the measured load displacement and modify the estimated velocity.

U.S. Pat. No. 5,219,420, Procedure for the Control of a Crane, of Kiiski et al. depicts a method for damping the swing of the load of a crane during a traversing motion of the trolley and/or bridge when the trolley bridge is controlled by a signal that controls the traversing motor. The length of the hoisting rope is determined and used for the calculation of the time of oscillation of the load swing, and when a new speed setting is given, a first control signal compensating the swing prevailing at the moment and a second control signal changing the speed are generated.

U.S. Pat. No. 5,127,533, Method of Damping the Sway of the Load of a Crane, of Virkkunen depicts a system for damping the sway of the load moved by the carriage of the crane, the load being suspended by at least one hoisting rope. The damping is achieved by using a discrete time-domain control system whose control interval is varied in accordance with the hoisting rope length while the control parameters remain constant. The system depicts the use of a transfer function in the formulation of the control and a discrete time-domain control. Unlike the present invention, all transfer functions presented by Virkkunen are formulated using continuous time-domain notation. In contradistinction, the transfer functions presented in the present invention are formulated using discrete time-domain notation. Virkkunen's system uses fixed-parameter control with a variable control interval. In contradistinction, the present invention uses a variable-parameter control with a fixed control interval. Virkkunen starts with a nominal control interval of 100 ms and modifies the control interval based on the cable length. In contradistinction, the present invention modifies the control parameters based on the cable length. Additionally, unlike Virkkunen, the present invention comprises an Infinite Impulse Response ("IIR") in the control system. As depicted in FIG. 3 of Virkkunen, the control method requires a measurement of the carriage position $X_T$, cable sway $\phi$, and cable length L. Equation 2 of Virkkunen is then applied to solve for the reference speed $r_T$. The present invention does not require any measurement of cable sway if there are no external disturbances such as wind or objects obstructing the crane's path. Also, the present invention does not require the measurement of carriage position because the operator's input is in terms of velocity.

U.S. Pat. No. 4,997,095, Methods of and System for Swing Damping Movement of Suspended Objects, of Jones et al. (including B. Petterson, co-inventor named in the present application) depicts methods of and system for damping a payload suspended from a gantry-style crane in accordance with a control algorithm based on the periodic motion of the suspended mass or by servoing on the forces induced by the suspended mass.

U.S. Pat. No. 4,916,635, Shaping Command Inputs to Minimize Unwanted Dynamics, of Singer et al. depicts a system where a sequence of impulses is determined which eliminates unwanted dynamics in the dynamic system. The impulse sequence is convolved with an arbitrary command input to drive the dynamic system to an output with a minimum of unwanted dynamics. The input signal is processed to counteract the effects of unwanted dynamics such as payload swing.

U.S. Pat. No. 4,756,432, *Crane Control Method*, of Kawashima et al. depicts a crane control method where a payload is moved at a predetermined velocity to a predetermined point by computer control to minimize swinging. Their invention is directed toward a two-pulse method in which mid-course constant velocity is somehow controlled. The control is performed in an accelerating period, a constant velocity travel, and a decelerating period separately, wherein the control is performed during the accelerating and decelerating periods by turning on and off predetermined accelerating and decelerating forces. The Kawashima et al. invention teaches away from the use of feedback control.

U.S. Pat. No. 4,717,029, *Crane Control Method*, of Yasunobu et al. depicts a method in which a payload suspended by a rope is laterally transported by a trolley, the accelerating and decelerating time of the trolley are obtained on the basis of the mass of the trolley, the mass of the suspended payload, and the rope length. During the constant speed running, the stop position of the trolley is predicted on the basis of the decelerating time.

U.S. Pat. No. 4,603,783, *Device on Hoisting Machinery for Automatic Control of the Movement of the Load Carrier*, of Tax et al. depicts an automatic control system for controlling the movement of a load and for steadying the associated pendulum-like motion of the load. The system includes a signal transmitter for sending signals for controlling the movement of a load carrier traction motor.

U.S. Pat. No. 4,512,711, *Unloading of Goods, Such as Bulk Goods from a Driven, Suspended Load-Carrier*, of Ling et al. depicts a method for controlling the lateral displacement of a trolley supporting goods to be unloaded at a certain location. A pendulum is held at a constant angle while the system decelerates to a stop and then accelerates in an opposite direction. The Ling et al. invention does not teach a continuum of solutions, does not use a non-linear model, and does not account for a change in period due to acceleration of the crane.

U.S. Pat. No. 3,921,818, *Crane Suspension Control Apparatus*, of Yamagishi depicts a system where a crane is accelerated and decelerated with two pulses, the second pulse being timed to counteract the swing of the payload.

U.S. Pat. No. 3,517,830, *Cranes*, of Virkkala depicts an arrangement for reducing the oscillations of the pendulum-like motion associated with movement of the load. A moving mechanism is provided with a synchronizing device, automatically functioning so that each change of acceleration is automatically succeeded by another equally great and similarly directed change of acceleration after a time, which is half the length of the period of oscillation of the load.

Auernig and Troger consider time optimal payload maneuvers of a gantry-style crane undergoing trolley translation and load-line length change. [J. W. Auernig and H. Troger, *Time Optimal Control of Overhead Cranes with Hoisting of the Load*, Automatica, Vol. 23, No. 4, pp. 437–447 (1987).] The coupled, nonlinear equations of motion and adjoint equations, obtained from the application of Pontryagin's maximum principle, are solved analytically for the cases of constant and variable hoisting speeds. In both cases, the maneuvers are developed such that the payload is residual oscillation free. Moustafa and Ebeid demonstrate a state-feedback controller for damping load sway for a gantry-style crane configured to move along two orthogonal directions in the horizontal plane. [Kamal A. F. Moustafa and A. M. Ebeid, *Nonlinear Modeling and Control of Overhead Crane Load Sway*, Journal of Dynamic Systems, Measurement, and Control, Vol. 110, pp. 266–271 (1988).] This work is expanded on by Ebeid et al. to incorporate actuator dynamics into the crane model. [A. M. Ebeid, Kamal A. F. Moustafa, and H. E. Emara-Shabaik, *Electromechanical Modeling of Overhead Cranes*, International J. of Systems Science, Vol. 23, No. 12, pp. 2155–2169 (1992).] Fliess et al. investigate a feedback linearizing controller for a one-dimensional gantry-style crane. [M. Fliess, J. Levine, and P. Rouchon, *A Simplified Approach of Crane Control Via a Generalized State-Space Model*, IEEE Proceedings of the 30th Conference on Decision and Control, Brighton, England, pp. 736–741 (1991).] Trolley traversal and load-line length changes are considered. Simulation results indicate the ability of the closed-loop controller to control load sway for relatively-slow maneuvers. Nguyen examines this same system where simulation and experimental results of a nonlinear state-feedback controller are used. [H. T. Nguyen, *State-Variable Feedback Controller for an Overhead Crane*, Journal of Electrical and Electronics Engineering, Australia, Vol. 14, No. 2, pp. 75–84 (June 1994).] Small motions are assumed about a specified operating point, which allows for decoupled equations of motion and decoupled controller design.

Despite the prodigious amount of swing-free crane systems of which these references are representative, a practical system that is capable of eliminating payload swing for a gantry-style crane that is under constant operator control (operator-in-the-loop control) has not been realized until the present invention. While most operators are very experienced in crane maneuvers, an appropriately-designed controller allows even an inexperienced operator to perform swing-free motions using an operator input or speed control device, such as a button box or a joystick. One reason such a system has not been realized is that a model for a typical gantry-style crane with a spreader is not just a simple pendulum suspended from a trolley (a simple pendulum model is depicted in FIG. 4); rather, the model for a gantry-style crane with a spreader is a quadrilateral with solid upper (the trolley) and lower (the spreader) portions pivotally connected through variable-length vertical portions (the cables) (quadrilateral models are depicted in FIGS. 3 and 5). The swing characteristics and dynamics of such a structure are different from a simple pendulum, and a successful swing-free crane must account for these characteristics. The swing-free operator control system and method described herein eliminates residual oscillation of suspended payloads on a gantry-style crane.

III. SUMMARY OF THE INVENTION

The present invention is a system and method for eliminating swing while subject to random operator operation, comprising an Infinite Impulse Response ("IIR") filter, which filters out unwanted frequencies to dampen load sway, and a Proportional-Integral ("PI") feedback controller. The IIR filter receives the input signal from the operator input device and transforms it into a signal in such a fashion that the resulting motion of the pendulum is swing free (i.e., prevents end-point swinging). The settling time $t_s$ of the IIR filter is a function of the natural frequency of oscillation, which is a function of the variable cable length. Thus, to decrease the settling time $t_s$ of the IIR filter, a desired time constant $\sigma$ of the IIR filter is selected to be less than the period of oscillation $\tau$. The variable control parameters of the IIR filter are updated in real time using measurements from a hoist cable length encoder. The PI feedback controller compensates for modeling errors and external disturbances, such as wind or perturbations caused by bumping into objects. The PI feedback controller operates on measurements provided by a cable angle sensor (sensor feedback). An especially important feature of the present invention is that it compensates for variable-length cable motions and multiple cables.

The present invention comprises a system for damping payload sway in a crane having a payload suspended by multiple variable-length cables from a trolley, the trolley being moveable in a horizontal plane and being controlled by a crane controller, the payload being moveable in a vertical plane, the system comprising cable length sensor means for determining the variable lengths of the multiple variable-length cables; and filter means for reacting to oscillation associated with movement of the payload in the vertical plane and movement of the trolley in the horizontal plane. Alternatively, the present invention comprises a system for damping payload sway in a crane having a payload suspended by multiple variable-length cables from a trolley, the trolley being moveable in a horizontal plane and being controlled by a crane controller, the system comprising cable length sensor means for determining the lengths of the multiple variable-length cables; and filter means for receiving input signals from an operator input device and for receiving the lengths of the multiple variable-length cables from the cable length sensor means, the input signals controlling the velocity and acceleration of the crane, the filter means converting the input signals into output signals readable by the crane controller to dampen the payload sway associated with movement of the crane, the filter means being characterized by variable control parameters. The system further comprises cable angle sensor means for sensing a change in at least one cable swing angle with respect to a vertical plane of the trolley, and feedback controller means for compensating for disturbances that are external to the system, wherein the feedback controller means provides feedback to the filter means, the feedback being characterized by the disturbances.

The present invention also comprises a method for damping payload sway in a crane having a payload suspended by multiple variable-length cables from a trolley, the trolley being moveable in a horizontal plane, comprising the steps of accelerating the trolley via input signals from an operator input device; providing filter means for receiving the input signals from the operator input device, the filter means being characterized by variable control parameters that can be updated; controlling motion of the trolley by the period of oscillation of the suspended payload and a scale factor $\kappa$ that controls a settling time $t_s$ of the filter means, the period of oscillation being characterized by $$\tau = 2\pi\sqrt{\frac{l_{eff}}{g}} = \frac{2\pi}{\omega},$$

where g is gravity, $l_{eff}$ is an effective variable cable length for the quadrilateral model (see FIGS. 3 or 5), and $\omega$ is the natural frequency of oscillation of the suspended payload, the scale factor $\kappa$ being characterized by $\kappa=\sigma/\omega$, where $\sigma$ is a desired time constant and $\omega$ is the natural frequency of oscillation of the suspended payload; determining the variable cable length; determining the natural frequency of oscillation $\omega$, updating the variable control parameters of the filter means; changing the input signals of the filter means to output signals, the output signals being a function of the input signals and the variable control parameters; and sending the output signals to a crane controller to damp payload sway.

The scope of applicability of the present invention can be realized and attained by means of the instrumentalities and combinations particularly pointed out in the appended claims. Further scope of applicability of the present invention will become apparent from the detailed description of the invention provided hereinafter. Similarly, certain objects, advantages, and novel features will become apparent to those of ordinary skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the spirit and scope of the invention will become apparent to those of ordinary skill in the art from the detailed description of the invention and claims that follow.

IV. BRIEF DESCRIPTION OF THE DRAWINGS

The accompanying figures, which are incorporated in and form part of the specification, further illustrate the present invention and, together with the detailed description of the invention, serve to explain the principles of the present invention.

V. DETAILED DESCRIPTION OF THE INVENTION

Figure 1:
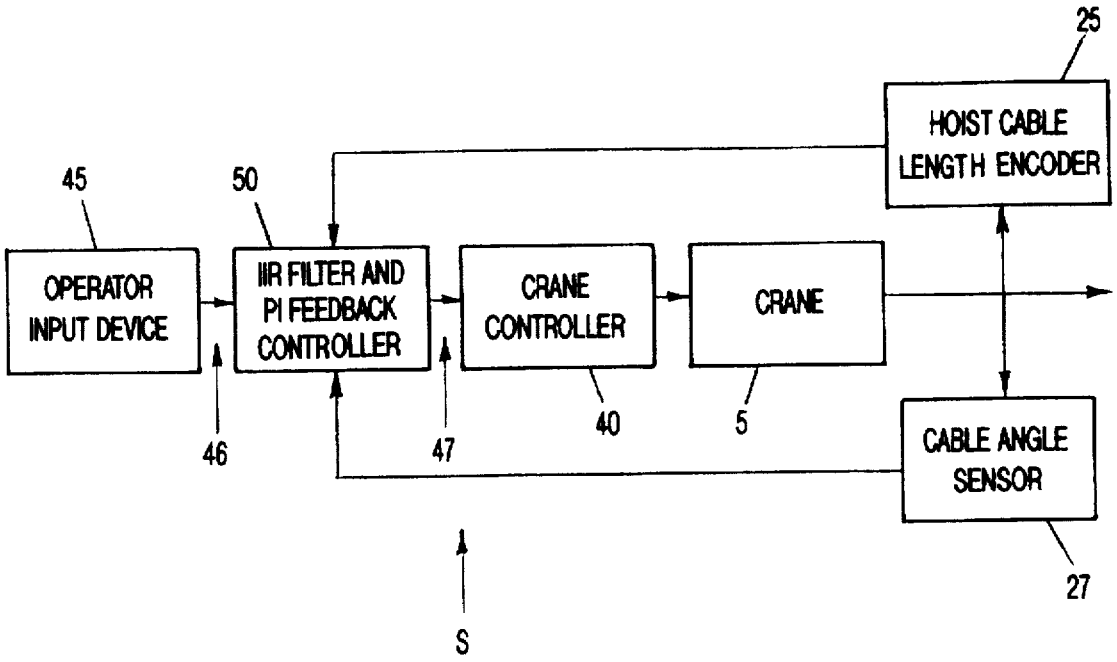
FIG. 1 is a block diagram of the overall crane control system including an IIR filter and PI feedback controller, a hoist cable length encoder, and a cable angle sensor in accordance with the present invention.

In recent years, many researchers have worked on the control of flexible structures. To date, a general solution to the controls problem has yet to be realized. One very important reason for this is that computationally-efficient mathematical methods do not exist for solving the extremely complex sets of partial differential equations and the associated boundary conditions that most accurately model gantry-style structures. While general solutions do not exist, some interesting solutions do exist for simplified cases. (See, for example, N. C. Singer, *Residual Vibration Reduction in Computer Controlled Machines*, Technical Report AI-TR 1030, MIT Artificial Intelligence Laboratory, Cambridge, Mass. (January 1989); A. D. Christian, *Design and Implementation of a Flexible Robot*, Technical Report AI-TR 1153, MIT Artificial Intelligence Laboratory, Cambridge, Mass. (August 1989); Stephen Yurkovich, Anthony P. Tzes, Iewen Lee, and Kenneth L. Hillsley, *Control and System Identification of a Two-Link Flexible Manipulator*, Proceedings of the 1990 IEEE International Conference on Robotics and Automation, Cincinnati, Ohio, pp. 1626–1631, (May 13–19, 1990); Brett R. Murphy and Ichiro Watanabe, *Digital Shaping Filters for Reducing Machine Vibration*, IEEE Transactions on Robotics and Automation, vol. 8, no. 2, pp. 285–289 (April 1992); Farshad Khorrami, *Analysis of Multilink Flexible Manipulators Via Asymptotic Expansions*, Proceedings of the 28th IEEE Conference on Decision and Control, Tampa, Fla., pp. 2089–2094 (December 1989); and Eduardo Bayo, Philip Papadopoulos, James Stubbe, and Miguel Angel Serna, *Inverse Dynamics and Kinematics of Multi-Link Elastic Robots: An Iterative Frequency Domain Approach*, The International Journal of Robotics Research, Vol. 8, No. 6, pp. 49–62 (December 1989).).

The present invention represents the dynamics of the gantry-style crane control system as a set of ordinary differential equations, implemented as an input-shaping infinite impulse response ("IIR") filter, in accordance with the present invention. Several embodiments of the input-shaping (IIR) filter are presented herein. A simple input-shaping filter that modifies the reference input so that the residual vibrations of Linear Time Invariant ("LTF") systems are eliminated was taught in N. C. Singer, *Residual Vibration Reduction in Computer Controlled Machines*, Technical Report AI-TR 1030, MIT Artificial Intelligence Laboratory, Cambridge, Mass., (January 1989). N. C. Singer's method involves convolving an input signal with a train of impulses that are calculated based on perfect knowledge of the crane system's flexible mode parameters. When these impulses are convolved with an arbitrary input, the crane system follows the input without vibration and with a time delay approximately equal to the length of the impulse train (typically equal to the period of vibration). This simplification has proven to provide reasonable response when applied to a three-degree-of-freedom flexible robot arm [A. D. Christian, *Design and Implementation of a Flexible Robot*, Technical Report AI-TR 1153, MIT Artificial Intelligence Laboratory, Cambridge, Mass. (August 1989)]. B. R. Murphy and I. Watanabe later extended Singer's work by applying digital theory to the design of the input-shaping filter. [Brett R. Murphy and Ichiro Watanabe, *Digital Shaping Filters for Reducing Machine Vibration*, IEEE Transactions on Robotics and Automation, vol. 8, no. 2, pp. 285–289 (April 1992); see also J. T. Feddema et al., *Methods for Controlling a Two-Link Flexible Arm*, Proceedings of the Fourth Topical Meeting on Robotics and Remote Systems, Albuquerque, N. Mex. (Feb. 24–28, 1991)].

The use of an IIR filter for reducing structural vibrations in remotely-operated robotic systems for fixed-length simple pendulum models was presented by John T. Feddema. [See John T. Feddema, *Digital Filter Control of Remotely Operated Flexible Robotic Structures*, Proceedings of the American Control Conference, San Francisco, Calif. (June 1993).] However, Feddema did not account for the use of multiple cables attached to the suspended payload, variable-length cables, or feedback control. Additionally, a second-order adaptive IIR filter was presented by G. R. Elliot et al. [G. R. Elliot, R. J. Fogler, N. Ahmed, and D. Hush. G. R. Elliot, R. J. Fogler, N. Ahmed, and D. Hush, *On a Second-Order Adaptive Infinite Impulse Response Filter*, SAND83-2298C, Sandia National Laboratories, Albuquerque, N. Mex. (1983)].

The various components or subassemblies of the control system S illustrated in FIG. 1 now will be described in detail. A conventional crane controller 40 for a gantry-style crane 5 is shown in FIG. 1 with an operator speed control/input device 45 that provides input signals 46 (e.g., electrical control signals from an operator's joystick controlling velocity or acceleration) to a conventional crane controller 40 to control motors (not shown) on crane 5 to move a spreader 20 (not shown—see FIG. 3 or 5) of crane 5 in any of the x, y, or z directions. As shown in FIG. 1, the present invention comprises an IIR filter and proportional integral ("PI") feedback controller 50 positioned between an operator input device 45 and a crane controller 40 for reducing payload oscillation in gantry-style cranes. The present invention alters the input signals 46 of the system so that residual vibration and swing are reduced. The crane system of the present invention in one embodiment is analyzed in the discrete time-domain and the IIR filter and PI feedback controller 50 are designed using pole-zero placement in the z-plane. Using this IIR filter and PI controller feedback system and method, the delay time associated with input-shaping IIR filters has been reduced to less than one-half of the period of oscillation $\tau$ of the pendulum-like motion associated with movement of the payload 30. Because of the nature of the resulting IIR filter, this IIR filter could be easily implemented with a single digital signal processing ("DSP") microchip in a manner well known to those of ordinary skill in the art, thus reducing the cost of implementation.

The configuration described herein makes the swing-free IIR filter and PI feedback controller 50 described herein especially suitable as an after market add on; it allows an existing crane controller 40 to remain intact. The IIR filter and PI feedback controller 50 can be added to existing or new cranes with minimal expense. The IIR filter and PI feedback controller 50 receives the input signals 46 from the operator input device 45 and transforms them into control signals 47 to be received by the crane controller 40 to prevent end-point swinging of the payload 30. The present invention further comprises a hoist cable length encoder 25 for measuring cable lengths 24 and 26 (FIG. 3) and a cable angle sensor 27 for measuring cable swing angles with respect to a vertical plane of the trolley in existing crane systems, which reduces cost and simplifies implementation. The variable control parameters of the IIR filter are updated in real time using output representing measurements from the hoist cable length encoder 25 according to the different embodiments of the IIR filter presented below. The hoist cable length encoder 25 measures the length of variable-length cables 24 and 26. A hoist cable length encoder 25 suitable for use in the present invention, for example, can be an absolute encoder such as manufactured by Allen-Bradley, Part No. 845D, which is commercially available. Cable angle sensor 27 provides cable swing measurements to the PI feedback controller. A cable angle sensor 27 suitable for use in the present invention, for example, can be a sensor based on capacitance principles to sense the position of the supporting cable in a pre-determined plane below the cable support. No contact is required between the cable position sensor and the cable, thereby eliminating wear and jamming. The cable position sensor need not be recalibrated or rebiased when the cable or hook is changed. Another type of cable angle sensor that can be used, for example, is an infrared beacon system, SIRRAH, offered by GIAT Industries—Gitech Capteurs, 155 Avenue de Grande-Bretagne F-31052 Toulouse.

An overhead bridge or gantry-style crane and an attachment cable are commonly used in the construction and shipping industries to transport heavy objects over a relatively large workspace. It is desirable to improve throughput by decreasing the time to transport the payload, which requires increasing the acceleration and velocity of the gantry-style crane and unfortunately, increases residual pendulum-like motion. Since the pendulum-like motion must be damped or allowed to decay naturally, throughput depends upon the effectiveness of damping.

Almost all previous work to eliminate swing in cranes has been applied to cranes having fixed-length cables. The present invention presents a dynamic model of a crane system having variable-length cables to determine on-line the estimated period of oscillation $\tau$ of the suspended payload 30 and to update the IIR filter control parameters accordingly. The present invention uses a variable-parameter control with a fixed control sampling interval T. The present invention modifies the control parameters based on the cable length l, which is variable. The control parameters of the IIR filter are updated in real time using the hoist cable length encoder 25. The dynamic model allows the operator to command the crane to hoist the payload 30 (y direction in FIG. 3 or 5) while trolleying in the horizontal direction (x direction in FIG. 3 or 5) along boom 15 without experiencing payload swing. This hoist and trolley operation is very common among crane operators.

Figure 3:
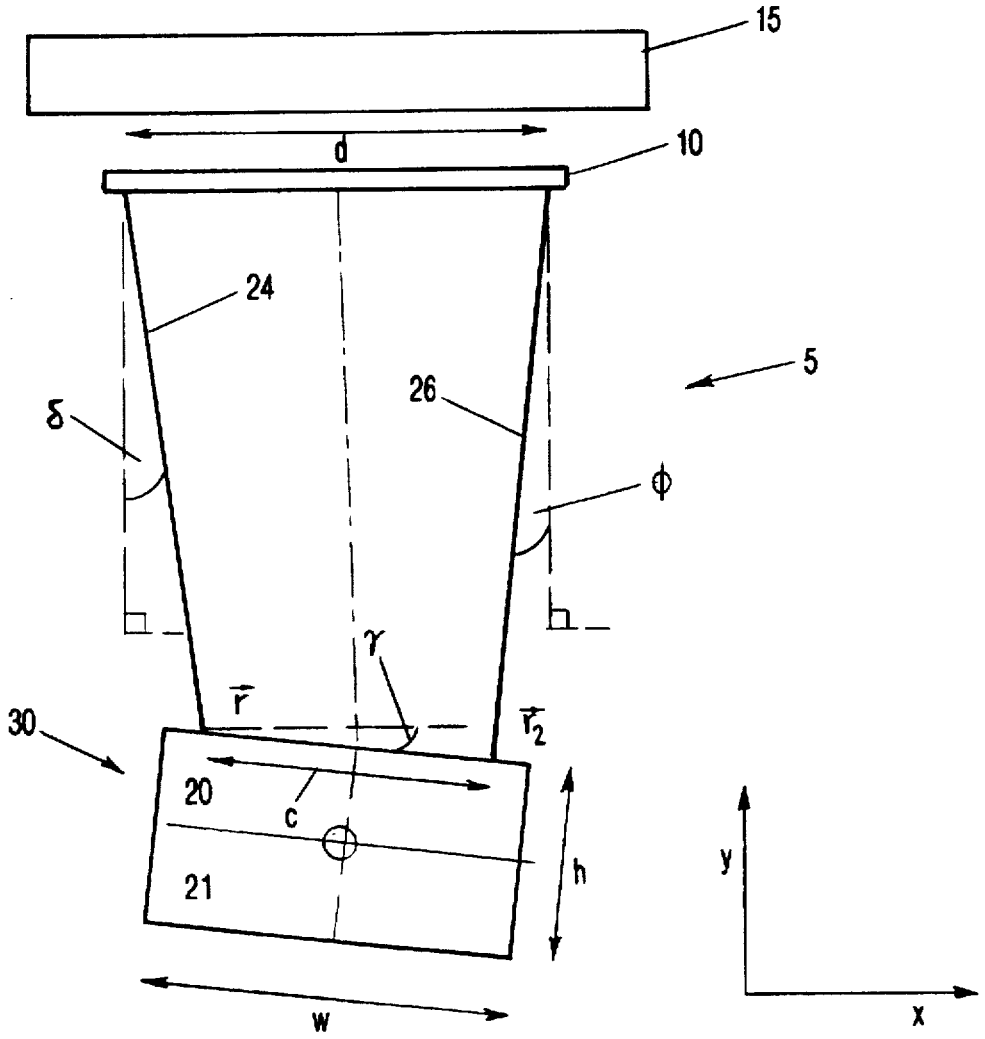
FIG. 3 is a block diagram of a swinging crane and payload depicted by a quadrilateral model with the trolley and the spreader portions pivotally connected through variable-length cables (with d>c) in accordance with the present invention.
Figure 5:
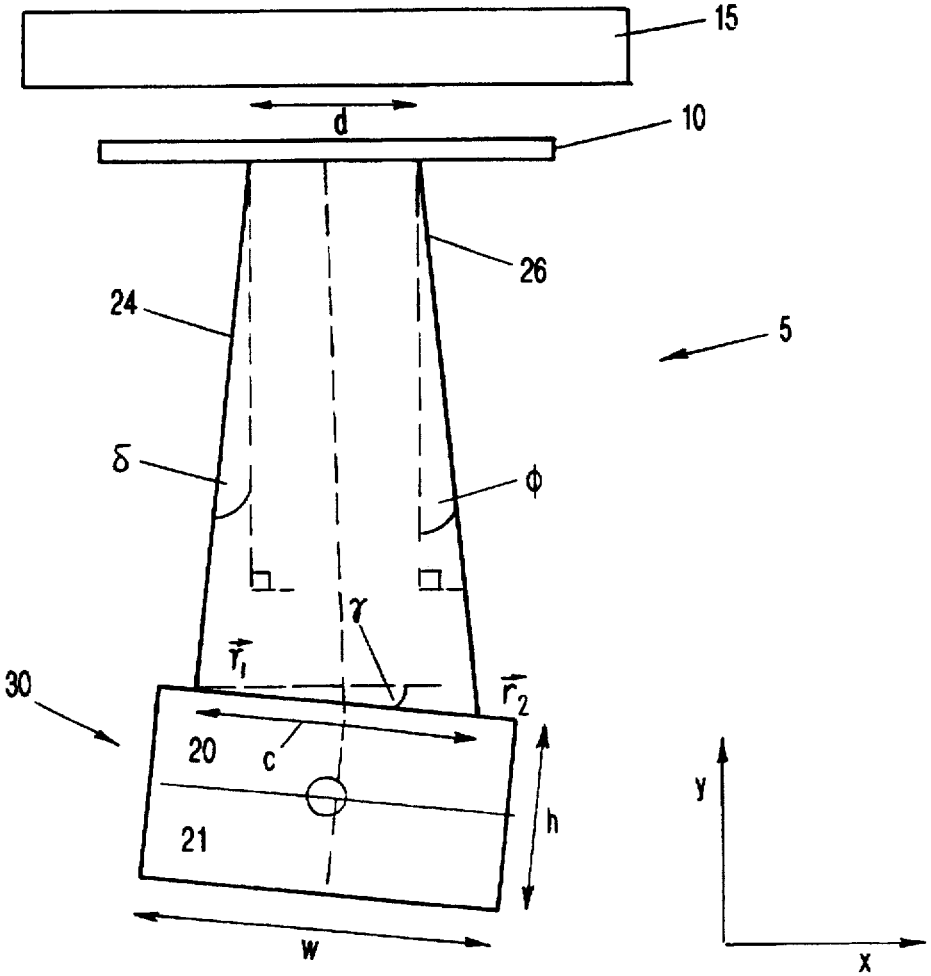
FIG. 5 is a block diagram of a crane and payload depicted by a quadrilateral model with the trolley and the spreader portions pivotally connected through variable-length cables (with d<c) in accordance with the present invention.

The present invention goes beyond a simple pendulum model when determining the IIR filter control parameters. FIGS. 3 and 5 show the manner in which most conventional gantry-style cranes, especially port cranes, are reeved. Through experimentation and modeling, it has been demonstrated by the present inventors that the period of oscillation $\tau$ of the pendulum-like motion associated with movement of the payload predicted with a simple pendulum model is different than the actual period of oscillation $\tau$ of a crane reeved as shown in FIGS. 3 or 5, which are modeled quadrilaterally herein. Therefore, the present invention uses more accurate embodiments than previously enjoyed by those skilled in the art of determining the period of oscillation $\tau$ of the pendulum-like motion associated with movement of the payload.

As discussed earlier, current industrial cranes that automatically compensate for swing motion typically work only for pre-planned motions where the desired start and end positions of the payload in crane coordinates are well specified. The acceleration and constant velocity times of the motion profiles are planned so that they are a function of the natural period of oscillation $\tau$ of the pendulum-like motion associated with movement of payload 30. The IIR filter component of the IIR filter and PI feedback controller 50 allows the operator to provide an arbitrary velocity command from an operator input device 45.

The various components or subassemblies of the control system illustrated in FIG. 2 now will be described in detail. In the embodiment of the present invention illustrated in FIG. 2, IIR filter and PI feedback controller 50 is implemented as an embedded, digital computer between the operator input device 45 and the crane controller 40. The system and method of the present invention can be adapted to run on a general purpose digital computer that is programmed.

Figure 2:
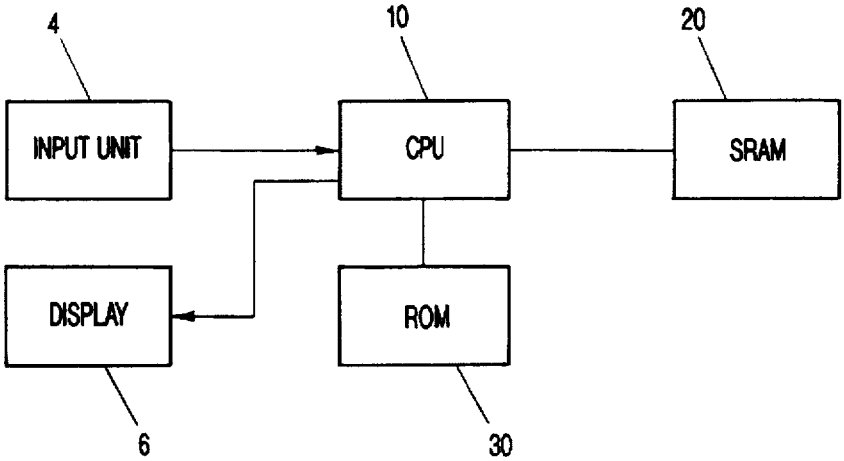
FIG. 2 is a block diagram of the computer apparatus used to implement the IIR filter and PI feedback controller in accordance with the present invention.

FIG. 2 illustrates a central processing unit ("CPU") 10 connected to a random access memory ("RAM") 20, which is preferably Static RAM ("SRAM") with a battery back-up, and a read only memory ("ROM") 30 for implementing the present invention. The method of the present invention is described in more detail below with the aid of FIG. 6. An input unit (e.g., keypad) 4 is connected to the CPU 10 for inputting crane system data into a data base stored in battery-backed-up SRAM 20. The input unit 4 can be a conventional digital computer input for entering crane system data into the data base by, for example, directly entering the crane system data into a data file via a keyboard, keypad, mouse, digitizer, light pen, or similar input device. The data input for the crane system parameters can include any physical characteristic data for the crane system such as top trolley pulley distance (dimension d in FIG. 3), spreader 20 pulley distance (dimension c in FIG. 3), spreader 20 width (dimension w in FIG. 3), spreader 20 height (dimension h in FIG. 3 or 5 minus height of container 21), payload 30 height (dimension h in FIG. 3 or 5), payload offset (added to cable length to change the center of gravity of the payload), hoist scale (cable length per hoist encoder angle), encoder offset (encoder angle at hoist offset), hoist offset (cable length at encoder offset or $$g\left(\frac{\tau}{2\pi}\right)^2\Big),$$

normal acceleration time (without swing-free IIR filtering), normal deceleration time (without swing-free IIR filtering), swing-free acceleration time (with swing-free IIR filtering), swing-free deceleration time (with swing-free IIR filtering), damping ratio $\xi$, scale factor $\kappa$, settling time $t_s$, deadband voltage (joystick input signal is considered zero within deadband, with or without filtering), joystick input signal, etc.

The foregoing examples of crane data initialization parameters can be stored for easy retrieval in static RAM 20. In addition, display means 6 is connected to the CPU 10 for displaying the crane system data and output. A conventional display means 6, such as a cathode ray tube ("CRT") or Liquid Crystal Display ("LCD") for example, can be used. The digital computer is also configured to include an analog-to-digital (A/D) interface for the IIR filter and PI feedback controller 50 for converting analog input signals from the input device 45 to digital format. The digital computer is also configured to include a digital-to-analog (D/A) interface for sending the output signals in analog format to the conventional crane controller 40.

In practice, for example, an embedded 80386 microprocessor-based general purpose digital computer purchased from Octagon Systems can be used to implement the IIR filter and PI feedback controller 50 described herein. The list of components that can be used are: 5025 Development System; 5252LP Card Cage, 2 slot, Table Mount; 5710-1 high-speed analog I/O card; 128K CMOS Static RAM;

LCD-4×40, LCD display with cable; LCD-IFD, LCD Display/Keyboard Interface; KP-3 Keypad with cable, and associated documentation, including a 5025 Control Card User's Manual. The assembly and use of the aforementioned components are considered to be well within the abilities of one of ordinary skill in the art and will not be discussed herein.

Figure 6:
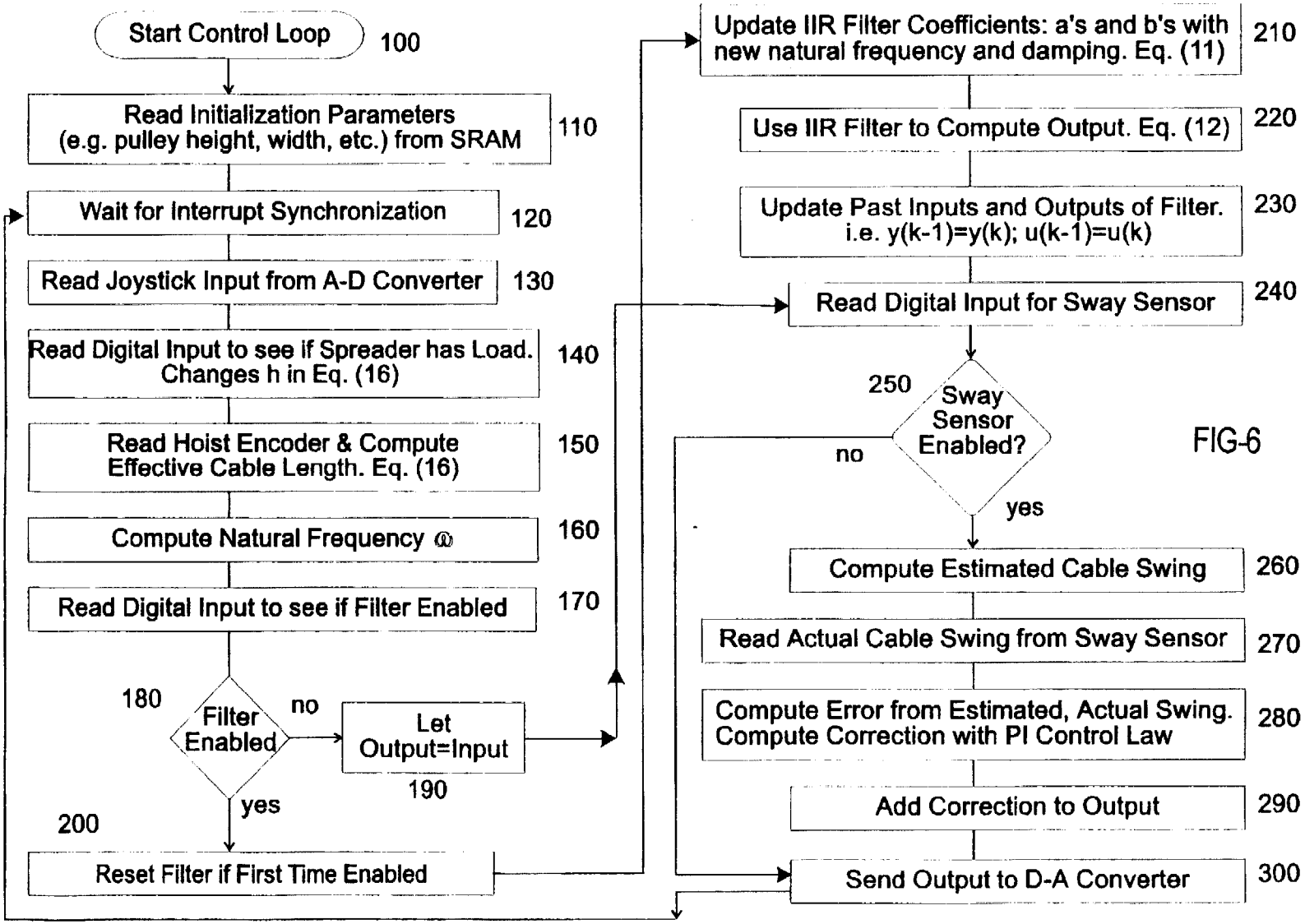
FIG. 6 is a flowchart of the method used to implement the IIR filter and PI feedback controller in accordance with the present invention.

The method of the present invention comprises a series of interdependent steps as illustrated in FIG. 6. The interdependent steps include sending input signals through an operator input device 45 to the IIR filter and PI feedback controller 50, determining the cable length l via readings from a hoist cable length encoder 25, determining the natural frequency of oscillation ω, updating the IIR filter variable control parameters $a_i$ and $b_i$ of Eq. (12) with the newly-determined natural frequency of oscillation ω and damping ratio ξ, determining the output of the IIR filter as a function of the input of the IIR filter, which includes convolving the input signal with the IIR filter, and estimating the cable swing angle, determining the actual cable swing angle via cable angle sensor 27, while continuously feeding back the error determined between the estimated and actual cable swing angle via a PI feedback controller, and outputting the response to a D/A converter to be received by the crane controller, which steps are described in more detail below. Synchronization is accomplished by continually checking a counter which is updated continuously.

Figure 1A:
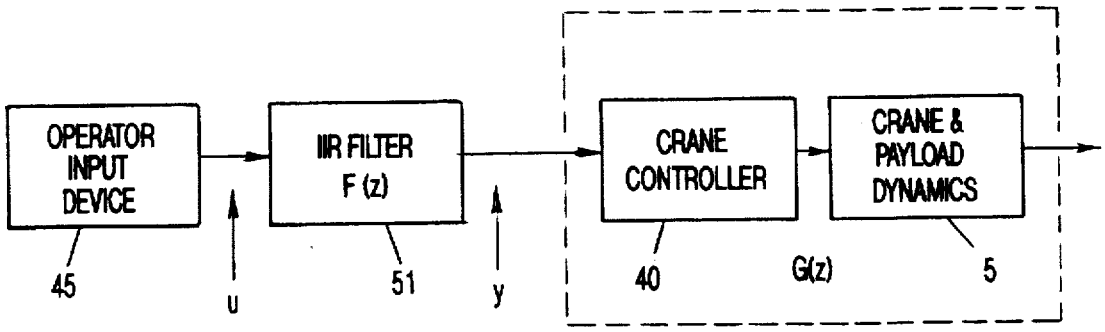
FIG. 1A is a block diagram of an open-loop model of the overall crane control system including an IIR filter in accordance with the present invention.
Figure 1B:
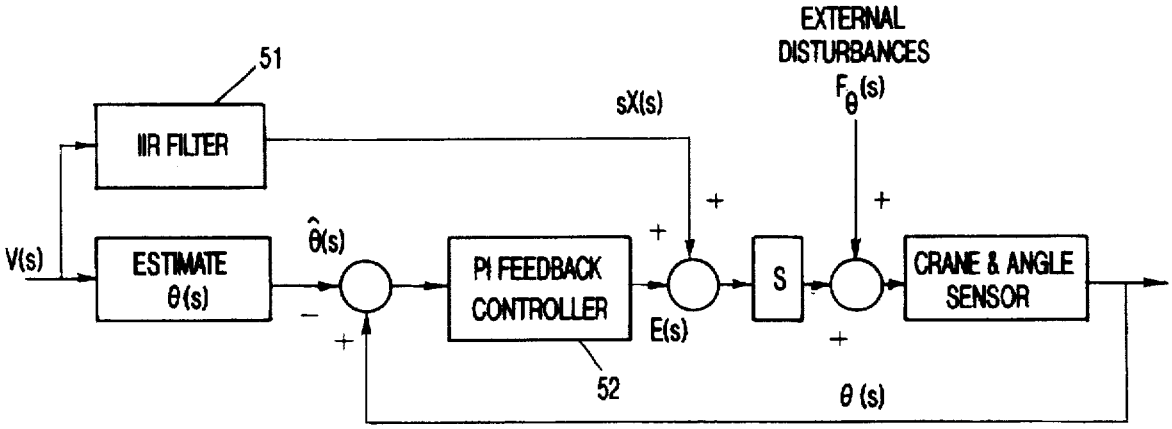
FIG. 1B is a block diagram of a closed-loop model of the overall crane control system including an IIR filter and a PI feedback controller in accordance with the present invention.

As illustrated in FIG. 6, the method begins by starting a control loop at Step 100. The control loop remains active throughout the entire crane maneuvering process. The initialization parameters, e.g., pulley height, width, etc., are read from static RAM 20 at Step 110. The control loop is instructed to wait for an interrupt synchronization at a predetermined time interval, e.g., every 0.01 seconds, at Step 120. Step 120 ensures that a fixed sampling period T is followed as digital control design and analysis requires a fixed sampling period. The analog input signals 46 are sent by the operator input device where they are received by the IIR Filter and PI Feedback Controller 50 through an analog-to-digital (A/D) converter at Step 130. At Step 140, a digital input signal is read from the crane controller 40 electronics to determine if the spreader has a container load associated with it. Dimension h in, for example Eq. (28), is changed accordingly. At Step 150, the hoist cable length encoder 25 is read and the effective cable length $l_{eff}$ is computed. At Step 160, the natural frequency of oscillation ω is determined by, for example, $$\omega=\sqrt{\frac{g}{l}} \text{ or } \omega=\sqrt{\frac{g}{l_{eff}}},$$

and the damping ratio ξ is determined by, for example, $$\xi=\frac{\dot{l}}{\sqrt{lg}},$$

where g is gravity, l is the cable length, and $\dot{l}$ is the velocity of the cable length. A signal is read from a bypass switch to determine whether the IIR filter is enabled at Step 170; the operator can set a hardware or software bypass switch to enable/disable the IIR filter. At Step 180, there is a decision block from which two different steps can be followed. The IIR filter can be enabled or disabled by either a hardware or software bypass switch if the operator decides to operate the crane with or without IIR filtering, respectively. For example, the bypass switch can be installed on the operator input device 45 for convenience. The bypass switch serves to remove the IIR filter from the control loop and returns control to the operator. The switch that enables or disables the IIR filter is integrated into the overall system in a manner well known to those of ordinary skill in the art and will not be discussed herein. If the IIR filter is not enabled, then the input signals 46 are set to equal the output signals 47 (i.e., y(k)=u(k) in Eq. (12)) at Step 190 so that the system operates without filtering. If the IIR filter is enabled, then it is reset to initial conditions at Step 200 if it is the first time it has been enabled so that it begins at a known starting point. For example, by resetting, the past input and output signals are set to the first input signals used. The IIR filter coefficients $a_i$ and $b_i$ in Eq. (12), which are functions of natural frequency of oscillation ω and damping ratio ξ, are changed at Step 210 to reflect the newly-determined natural frequency of oscillation ω and damping ratio ξ obtained in Step 160. At Step 220, the IIR filter, for example defined in Eq. (12), determines the output signal 47 (y in FIG. 1A) of the IIR filter as a function of the input signal 46 (u in FIG. 1A) of the IIR filter. At Step 230, the previously-determined input signals 46 and output signals 47 of the IIR filter are updated for the following iteration of Step 220, i.e., y(k−1)=y(k) and u(k−1)=u(k) in the difference equation Eq. (12). At Step 240, the computer-implemented method then reads a digital input signal from the cable angle sensor 27 to determine the cable angle sensor 27 is enabled. At Step 250, there is a decision block from which two different steps can be followed. At Step 250, if the cable angle sensor 27 is not enabled, then the method skips to Step 300 where the output signal 47 is sent to a digital-to-analog (D/A) converter for converting the digital signal to an analog signal for transmitting to crane controller 40. At Step 260, an estimated cable swing angle θ is determined according to Eq. (14). At Step 270, the actual or measured cable swing angle θ is read from the cable angle sensor 27. At Step 280, the error between the estimated and measured cables swing angle is determined and corrected using the PI feedback controller in accordance with Eq. (15). At Step 290, the correction is added to the control signal as shown in FIG. 1B. Again at Step 300, the control signal 47 is sent to a digital-to-analog (D/A) converter for converting the digital signal to an analog signal for transmitting to crane controller 40 until the payload 30.

The present invention can be configured to use an existing operator joystick, which eliminates the need for additional operator training. In practice, for example, the input signal, which is the joystick output signal, and output signal of the IIR filter ranges from −10 to +10 volts. Additionally, the present invention can be configured to accommodate several parameter changes via a 4×4 keypad (or a similar operator input device) and the display means 6, e.g., LCD monitor, of the embedded computer. One such parameter is the desired settling time $t_s$ of the pendulum-like motion. A longer settling time $t_s$ is more robust than a shorter settling time $t_s$, but the longer setting time $t_s$ results in a longer delay when the operator releases the input device (e.g., joystick). The present inventors have demonstrated that very good results can be achieved with a settling time $t_s$ slightly greater than one-half of the period of oscillation τ, where $$\tau=2\pi\sqrt{\frac{l}{g}}=\frac{2\pi}{\omega},$$

l is the cable length, g is gravity, and ω is the natural frequency of oscillation, e.g., $$\omega = \sqrt{\frac{g}{l}}.$$

This result is approximately twice as fast as, for example, the input-shaping filter of Singer et al. The resulting savings in time to load and unload a port crane when oscillation is dampened using the present invention is as much as 25 percent.

Additionally, previous crane controllers do not include sensor feedback, which is used in the present invention to reduce swing caused by modeling errors and external disturbances. The PI feedback controller component of IIR filter and PI feedback controller 50 compensates for modeling errors and external disturbances such as wind. The PI feedback controller is used where the desired input is determined from a dynamic model including the effects of the IIR filter.

The various components or subassemblies of the system illustrated in FIG. 3 now will be described in detail. The present invention is directed toward, for example, a conventional gantry-style crane 5 of the class having a boom 15 that is stationary with respect to the x direction, which is parallel to boom 15, and is movable by conventional means (not shown) under the control of an operator (not shown) in the z direction (perpendicular to the page). Crane 5 includes a trolley 10 which is movable in the x direction along boom 15. A spreader 20 is moveable in they direction and is suspended by a plurality of cables 24 and 26 of variable cable lengths l which conventionally extend from windlasses (not shown). Spreader 20, with a top trolley pulley distance d, is attached to the top of a payload 30 (for a combined height h) in a manner well known to those of ordinary skill in the art. Cables 24 and 26 are not necessarily parallel with respect to each other although they can be parallel with respect to each other. Typically, payload 30 is a spreader and container having a length (perpendicular to the page, not shown) on the order of 10 m, a width w on the order of 2.5 m, and a height h on the order of 3 m. The weight of payload 30 is typically many tons. If payload 30 is caused to swing without the swing-free correction of the present invention, then it typically takes several minutes to stabilize or decay naturally, which translates to cost.

An IIR filter embodiment will now be described in detail with the aid of the simple pendulum model shown in FIG. 4. As the payload 30 moves, some of the kinetic energy KE will be converted into potential energy PE. Lagrange's equations are applied to this system where the Lagrangian is the difference between the kinetic energy KE and the potential energy PE: L=KE–PE. With the aid of FIG. 4, KE and PE are described as:

$$KE = \frac{1}{2}\, mv^2 = \frac{1}{2}\, m\dot{x}_c^2 \qquad \text{Eq. (1)}$$

$$PE = mgh_y = mgl(-\cos(\theta) + 1), \qquad \text{Eq. (2)}$$

where m is mass, g is gravity, l is the cable length between the top trolley pulleys and the spreader 20 pulleys, and $h_y$ is the height in the y direction. The present invention controls the velocity of the crane $\dot{x}_c$ in the x direction. It is noted that the present invention need only monitor the cable length l, and it is not necessary to know the center of gravity of the spreader and container—see dimension r in FIG. 4. The equations of motion for the degree of freedom θ can be determined for a small cable swing angle θ and its derivatives as shown in Eq. (3). For the simple pendulum model illustrated in FIG. 4, cable swing angle θ is a second-order function of acceleration $\ddot{x}_c$ as follows:

$$\left(-\frac{\ddot{x}_c}{l}\right) = \ddot{\theta} + 2\frac{\dot{l}}{l}\,\dot{\theta} + \frac{g}{l}\,\theta. \qquad \text{Eq. (3)}$$

where $\ddot{x}_c$ is the commanded acceleration of the crane in the x direction, l is the cable length, $\dot{l}$ is the velocity of the cable length l as it is being hoisted in the y direction, g is gravity $$\left(\frac{9.8m}{s^2}\right).$$

The resulting transfer function of the system is:

$$\frac{\theta(s)}{s^2X(s)} = \frac{\frac{-1}{l}}{s^2 + 2\xi\omega s + \omega^2}, \qquad \text{Eq. (4)}$$

where the natural frequency of oscillation $$\omega = \sqrt{\frac{g}{l}}$$

and the damping ratio $$\xi = \frac{\dot{l}}{\sqrt{lg}}.$$

Thus, the damping ratio ξ changes depending upon the velocity of the cable length $\dot{l}$, and for small changes in velocity $\dot{l}$, the damping ratio ξ can be ignored. Therefore, the impulse response h(t) of the system to acceleration in the x direction is:

$$h(t) = \frac{-1}{\omega l\sqrt{1-\xi^2}}\, e^{-\xi\omega t}\sin(\omega t\sqrt{1-\xi^2}).$$

A continuous time-domain embodiment of the input-shaping IIR filter of the present invention is described as follows. Assume the actual (measured) plant (crane system) transfer function G(s) is the second-order, under-damped system (open-loop control system model) as shown in FIG. 1A:

$$G(s) = \frac{K\omega^2}{s^2 + 2\xi\omega s + \omega^2} = \frac{K(\alpha^2+\beta^2)}{(s+\alpha)^2+\beta^2}, \qquad \text{Eq. (5)}$$

where $$\alpha = \xi\omega,$$

$$\beta = \omega\sqrt{1-\xi^2}, \text{ and}$$

K is the overall system gain, ω is the natural frequency of oscillation, and ξ is the damping ratio.

The IIR filter is formed by canceling the under-damped poles and replacing them with three critically-damped poles. Assume the desired plant transfer function $G_d(s)$ is the critically-damped transfer function:

$$G_d(s) = \frac{K\sigma^3}{(s+\sigma)^3}, \qquad \text{Eq. (6)}$$

where σ is the desired third-order time constant, and K is the overall system gain. The poles of the actual plant transfer function G(s) can be canceled and the poles of the desired plant transfer function $G_d(s)$ can be inserted if the transfer function F(s) of the IIR filter is:

$$F(s)=\frac{G_d(s)}{G(s)}=\left(\frac{\sigma^3}{\omega^2}\right)\frac{(s^2+2\xi\omega s+\omega^2)}{(s+\sigma)^3}\ . \qquad \text{Eq. (7)}$$

The desired third-order time constant $\sigma$ must be carefully selected such that the torque limits of the trolley motors are not exceeded, which value $\sigma$ of will become apparent to one of ordinary skill in the art.

Regarding the discrete embodiment of this IIR filter, design by emulation method (G. F. Franklin, J. D. Powell, and M. L. Workman, *Digital Control of Dynamic Systems*, 2d Ed. Addison-Wesley Publication Company, Reading, Mass. (1990).) produced desirable results when the sampling rate was relatively high (e.g., 2 ms), while a direct z-plane design method was used when the sampling rate was low (e.g., 48 ms). In the latter case (z-plane design method), the plant model is first discretized and then the IIR filter design is conducted in the z-plane. The zero-order hold, discrete time-domain equivalent G(z) of the plant model is:

$$G(z)=(1-z^{-1})Z\left(\frac{G(s)}{s}\right)=\frac{K(Az+B)}{(z^2-2e^{-\alpha T}\cos(\beta T)z+e^{-2\alpha T})}\ , \qquad \text{Eq. (8)}$$

where $$A=1-e^{-\alpha T}\cos(\beta T)-\frac{\alpha}{\beta}\,e^{-\alpha T}\sin(\beta T),\ \text{and}$$

$$B=e^{-2\alpha T}+\frac{\alpha}{\beta}\,e^{-\alpha T}\sin(\beta T)-e^{-\alpha T}\cos(\beta T).$$

The desired discrete time-domain equivalent $G_d(z)$ of the plant model is:

$$G_d(z)=(1-z^{-1})Z\left(\frac{G_d(s)}{s}\right)=\frac{z^2C+zD+E}{(z-e^{-\sigma T})^3}\ , \qquad \text{Eq. (9)}$$

where $$C=1-e^{-\sigma T}(1+\sigma T+0.5\sigma^2T^2),$$
$$D=e^{-\sigma T}(-2+\sigma T+0.5\sigma^2T^2)+e^{-2\sigma T}(2+\sigma T-0.5\sigma^2T^2),$$
and
$$E=e^{-2\sigma T}(1-\sigma T+0.5\sigma^2T^2)-e^{-3\sigma T}.$$

The resulting transfer function F(z) for the IIR filter is obtained by dividing the desired plant transfer function $G_d(z)$ by the actual plant transfer function G(z) as follows:

$$F(z)=\frac{G_d(z)}{G(z)}=\frac{(z^2C+zD+E)(z^2-2e^{-\alpha T}\cos(\beta T)z+e^{-2\alpha T})}{(Az+B)(z-e^{-\sigma T})^3}\ . \qquad \text{Eq. (10)}$$

Notice that if A=B, then the pole B/A is on the unit circle at (−1), which means that one of the IIR filter's output modes changes sign every sample. If the sampling period T is small, then the residual of this mode is very small; however, as the sampling period T increases, this effect becomes very noticeable. Therefore, this pole was moved to zero, and the gain of the IIR filter was increased to provide unity steady state gain, i.e., $-a_1-a_2-a_3+b_0+b_1+b_2+b_3+b_4=1$. The resulting transfer function for the IIR filter is:

$$F(z)=\frac{b_0+b_1z^{-1}+b_2z+b_3z^{-3}+b_4z^{-4}}{1+a_1z^{-1}+a_2z^{-2}+a_3z^{-3}} \qquad \text{Eq. (11)}$$

where $$a_1=(-3e^{\sigma T}),$$

$$a_2=3e^{-2\sigma T},$$

$$a_3=(-e^{-3\sigma T}),$$

-continued $$M=\frac{B}{A}\,(1-3e^{-\sigma T}+3e^{-2\sigma T}-e^{-3\sigma T}),$$

$$b_0=\frac{C}{A(1+M)}\ ,$$

$$b_1=\frac{1}{A(1+M)}\,[D-2Ce^{-\alpha T}\cos(\beta T)],$$

$$b_2=\frac{1}{A(1+M)}\,[E-2De^{-\alpha T}\cos(\beta T)+Ce^{-2\alpha T}],$$

$$b_3=\frac{1}{A(1+M)}\,[-2Ee^{-\alpha T}\cos(\beta T)+De^{-2\alpha T}],\ \text{and}$$

$$b_4=\frac{1}{A(1+M)}\,[Ee^{-2\alpha T}].$$

The resulting difference equation is:

$$y(k)=-a_1y(k-1)-a_2y(k-2)-a_3y(k-3)+b_0u(k)+b_1u(k-1)+b_2u(k-2)+b_3u(k-3)+b_4u(k-4) \qquad \text{Eq. (12)}$$

where u(k) represents the input signal and y(k) represents the output signal of the IIR filter at discrete time k.

Figure 4:
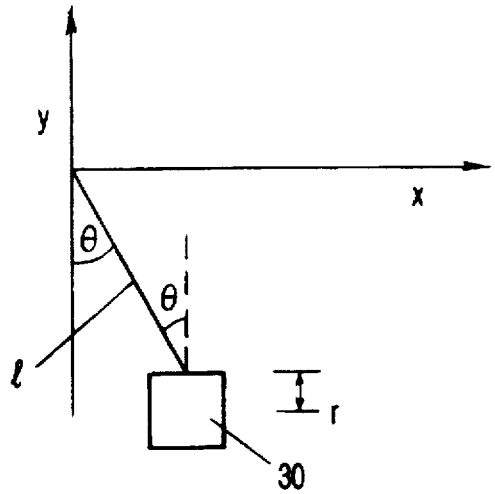
FIG. 4 is a block diagram of a crane and payload depicted by a simple pendulum model in accordance with the present invention.

For the simple pendulum model shown in FIG. 4, the coefficients $a_i$ and $b_i$ in Eq. (11) above are determined by five variables: g, l, $\xi$, $\kappa$, and T. The natural frequency of oscillation $\omega$ of a simple pendulum is determined by the square root of gravity g over the variable-cable length l, or $$\omega=\sqrt{\frac{g}{l}}\ .$$

Figure 7:
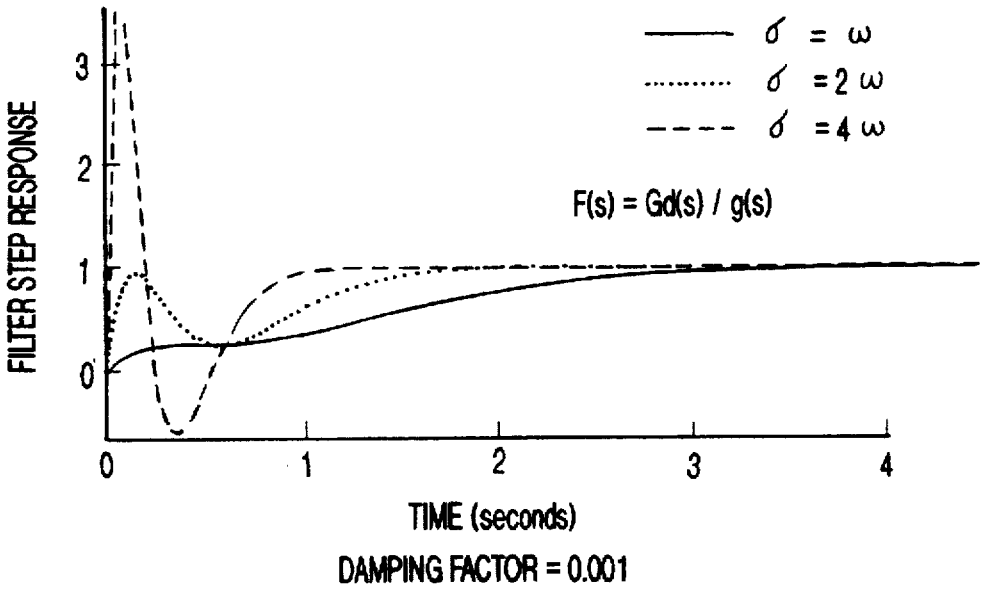
FIG. 7 illustrates the step response to an IIR filter embodiment in accordance with the present invention.

The damping ratio $\xi$ of the simple fixed-cable length pendulum is ideally zero. For a variable-cable length pendulum, the damping ratio $\xi$ changes depending on cable length velocity $\dot{l}$, i.e., the velocity in which the cables 24 and 26 are hoisted upward. The variable $\kappa$ is a scale factor used to decrease the settling time $t_s$ of the IIR filter and is determined by $\kappa=\sigma/\omega$. By judicious choice of scale factor $\kappa$, the settling time $t_s$ of the IIR filter can be specified, which will become apparent to one of ordinary skill in the art. Experiments have shown that performance degrades considerably when scale factor $\kappa$ is chosen such that the settling time $t_s$ is less than 33 percent of the period of oscillation $\tau$, which is expected because the sensitivity of the control to parameter identification errors increases as the desired settling time $t_s$ decreases. The larger the value of scale factor $\kappa$, the shorter the settling time $t_s$ of the IIR filter. A shorter settling time $t_s$, however, means that the IIR filter can drive the trolley motors faster than their acceleration limits. For example, the variable scale factor $\kappa$ can be set to $\kappa=2$ to shorten the settling time $t_s$ of the IIR filter, which assures that the torque limits of the trolley motors are not exceeded and provides a settling time $t_s$ approximately equal to one half the period of vibration. The sampling period T for the embedded controller can be 0.01 seconds, i.e., sampling rate of 100 Hz. FIG. 7 illustrates the step response to the IIR filter of the present invention for different scale factors $\kappa$ ($\kappa$=1, 2, and 4) when the sampling period T is 0.01 seconds and $\omega$=2.285 rad/s.

The present invention reduces the time delay effect of the input-shaping filters taught by Singer. For example, when applying Singer's input-shaping filter to a gantry-style crane with a suspended payload, the time delay of the system was equal to the period of oscillation $\tau$, which is, for example, over 11 seconds with 30 meters of cable. This is unacceptable when trying to position a payload. As a result, the problem was analyzed using both continuous time-domain and discrete time-domain control methods as described above.

The various components or subassemblies of the system illustrated in FIG. 1B now will be described in detail. The IIR filters of the present invention discussed herein are used to control modeled parameters. As discussed earlier, the present invention further comprises a PI feedback controller 52 to compensate for errors from external disturbances, such as wind and bumping into objects. The feedback and disturbance are added to the plant as shown in FIG. 1B. The external disturbances $F_\theta(s)$ about cable swing angle θ are represented as:

$$F_\theta(s) = ml^2\left[(s^2 + 2\xi\omega s + \omega^2)\theta(s) + \frac{s^2X(s)}{l} + \frac{sE(s)}{l}\right] \quad \text{Eq. (13)}$$

The estimated cable swing angle θ is defined by the continuous time-domain transfer function $\hat{\theta}(s)$, with the aid of FIG. 1B, as:

$$\hat{\theta}(s) = \left(-\frac{sV(s)}{l(s+\alpha)^3}\right)\left(\frac{\alpha^3}{\omega^2}\right), \quad \text{Eq. (14)}$$

where V(s) is the commanded velocity.

One of ordinary skill in the art can implement a digital version of the estimated cable swing angle and, therefore, is not discussed herein. The PI feedback controller 52 is represented as:

$$\frac{E(s)}{(\theta(s) - \hat{\theta}(s))} = K_p + \frac{K_I}{s}. \quad \text{Eq. (15)}$$

Therefore, the error sent from the PI Feedback controller 52 to the plant is represented as:

$$E(s) = \left(K_P + \frac{K_I}{s}\right)(\theta(s) - \hat{\theta}(s)) \quad \text{Eq. (16)}$$

Next the gains $K_P$ and $K_I$ for the PI feedback controller 52 can be derived upon inspection from the following relationship:

$$\frac{\theta(s) - \hat{\theta}(s)}{F_\theta(s)} = \frac{1}{ml^2\left[s^2 + \left(2\xi\omega + \frac{K_P}{l}\right)s + \left(\omega^2 + \frac{K_I}{l}\right)\right]} \quad \text{Eq. (17)}$$

Gains $K_P$ and $K_I$ for the PI feedback controller 52 are chosen such that stability is assured and near critical damping is achieved. Note that for stability, $K_I > l\omega^2$. Gains $K_P$ and $K_I$ are selected to provide a fast critically-damped response as follows:

$$K_P = l\left[(-2\xi\omega) + 2\sqrt{\omega^2 + \frac{K_I}{l}}\right] \quad \text{Eq. (18)}$$

$$K_I = l\left[-\omega^2 + \frac{[\ln(t_s) - \ln(0.05)]^2}{t_s^2}\right] \quad \text{Eq. (19)}$$

It was noted earlier that a typical crane does not act like a simple pendulum because of the crane rigging. Thus, two different quadrilateral models of a crane are illustrated in FIGS. 3 and 5 to illustrate the dynamics of the crane. FIG. 3 illustrates a crane system 5 with top trolley pulley distance d greater than spreader pulley distance c; FIG. 5 illustrates a crane system 5 with top trolley pulley distance d less than spreader pulley distance c.

The various components or subassemblies of the system illustrated in FIG. 3 (alternatively, FIG. 5 can be used) now will be described in detail. Recall that the natural frequency of oscillation $$\omega = \sqrt{\frac{g}{l}}$$

and the damping ratio $$\xi = \frac{\dot{l}}{\sqrt{lg}}.$$

The following embodiment determines the effective cable length $l_{eff}$ for use in determining the natural frequency of oscillation $$\omega = \sqrt{\frac{g}{l_{eff}}},$$

and thus, the period of oscillation $$\tau = 2\pi = \sqrt{\frac{l_{eff}}{g}} = \frac{2\pi}{\omega}.$$

As discussed earlier, as the payload 30 moves, some of the kinetic energy KE will be converted into potential energy PE. Lagrange's equations are applied to this system where the Lagrangian is the difference between the kinetic energy KE and the potential energy PE: L=KE–PE. With the aid of FIG. 3 or 5, KE and PE for the quadrilateral model illustrated therein, and from which the equations of motion can be derived, are described as:

$$KE = \frac{1}{2}m\dot{\vec{r}}_m \cdot \dot{\vec{r}}_m + \frac{1}{2}I_z\dot{\gamma}^2, \quad \text{Eq. (20)}$$

$$PE = mgh_y = \frac{1}{2}mg\left[-l\cos(\delta - \delta_0) + \cos(\delta) - \frac{w}{c}(d + l(\sin(\delta - \delta_0) - \sin(\delta)))\right], \quad \text{Eq. (21)}$$

where m is mass, g is gravity, l is the cable length between the top trolley pulleys and the spreader pulleys, $h_y$ is the height in the y direction, $$\vec{r}_m = \left[x + \frac{1}{2}l(\sin(\phi) + \sin(\delta)) - \frac{wl}{2c}(\cos(\phi) - \cos(\delta))\right]\hat{i} + \left[\left(-\frac{1}{2}\right)l\left(\cos(\phi) + \cos(\delta) - \frac{w(d + l(\sin(\phi) - \sin(\delta)))}{2c}\right)\right]\hat{j},$$

$I_z$ is the mass moment of inertia of the spreader and/or the container, $$I_z = \frac{m(h^2 + w^2)}{12},$$

$$\dot{\gamma} = \frac{\dot{\phi}[-dl\sin(\phi) - l^2(1 - \cos(\phi - \delta))] + \dot{\delta}[dl\sin\delta - l^2(1 - \cos(\phi - \delta))]}{c^2}, \text{ and}$$

-continued $$\delta_o = \frac{d-c}{l}.$$

The foregoing definitions are in terms of both cable swing angles $\phi$ and $\delta$ and the mathematic models can become relatively complicated. Thus, the definitions are simplified by expressing cable swing angle $\phi$ as a linear function of cable swing angle $\delta$. The relationship between cable swing angles $\phi$ and $\delta$ in a crane system having variable length cables 24 and 26, which are not necessarily parallel, is described by the non-linear equation:

$$dl(\sin(\phi) - \sin(\delta)) + l^2(1 - \cos(\phi - \delta)) = \frac{c^2 - d^2}{2}, \quad \text{Eq. (22)}$$

which is derived from the relationship:

$$c^2 = (\vec{r}_2 - \vec{r}_1)\cdot(\vec{r}_2 - \vec{r}_1), \quad \text{Eq. (23)}$$

where the cables 24 and 26 are represented as $\vec{r}_1$ and $\vec{r}_2$, respectively:

$$\vec{r}_1 = (x + l\sin(\delta))\hat{i} - (l\cos(\delta))\hat{j},$$

$$\vec{r}_2 = (x + d + l\sin(\phi))\hat{i} - (l\cos(\phi))\hat{j}.$$

Expressing cable swing angle $\phi$ as a linear function of cable swing angle $\delta$ and applying Taylor's series expansion of sine and cosine simplifies the equations used herein as follows:

$$\phi \cong \delta + \frac{(-d \pm c)}{l}. \quad \text{Eq. (24)}$$

Although there are two solutions for cable swing angle $\phi$, the solution of interest in the present invention is:

$$\phi \approx \delta - \frac{d-c}{l} = \delta - \delta_0, \quad \text{Eq. (25)}$$

$$\text{where } \delta_0 = \frac{d-c}{l}.$$

In order to apply an appropriate feedback control scheme to this quadrilateral model, it should first be linearized about an equilibrium state. Linearizing for small $\delta$ and $\delta_0$ greatly simplifies the equations of motion, i.e., let $\sin(\delta)=\delta$, and let $\cos\delta=1$. Then, $$\sin(\delta-\delta_0) = \sin(\delta)\cos(\delta_0) - \cos(\delta)\sin(\delta_0) = \delta\cos(\delta_0) - \sin(\delta_0) = \delta, \quad \text{Eq. (26)}$$

and $$\cos(\delta-\delta_0) = \cos(\delta)\cos(\delta_0) + \sin(\delta)\sin\delta_0 = \cos\delta_0 + \delta\sin(\delta_0) = 1. \quad \text{Eq. (27)}$$

The dynamic description for this embodiment approximates the effective cable length $l_{eff}$ as follows:

Eq. (28)

$$l_{eff} = l\left\{ 0.5\left[1 + \frac{w^2}{c^2} + \left(1 - \frac{w^2}{c^2}\right)\cos(\delta_0) - 2\frac{w}{c}\sin(\delta_0)\right] + \frac{l^2(h^2+w^2)}{3c^4}(1-\cos(\delta_0))^2 \right\}.$$

The point mass term of Eq. (28) is $$\left\{ 0.5\left[1 + \frac{w^2}{c^2} + \left(1 - \frac{w^2}{c^2}\right)\cos(\delta_0) - 2\frac{w}{c}\sin(\delta_0)\right] \right\}$$

and the rotational inertia terms of Eq. (28) is $$\left\{ \frac{l^2(h^2+w^2)}{3c^4}(1-\cos(\delta_0))^2 \right\}.$$

Figure 8:
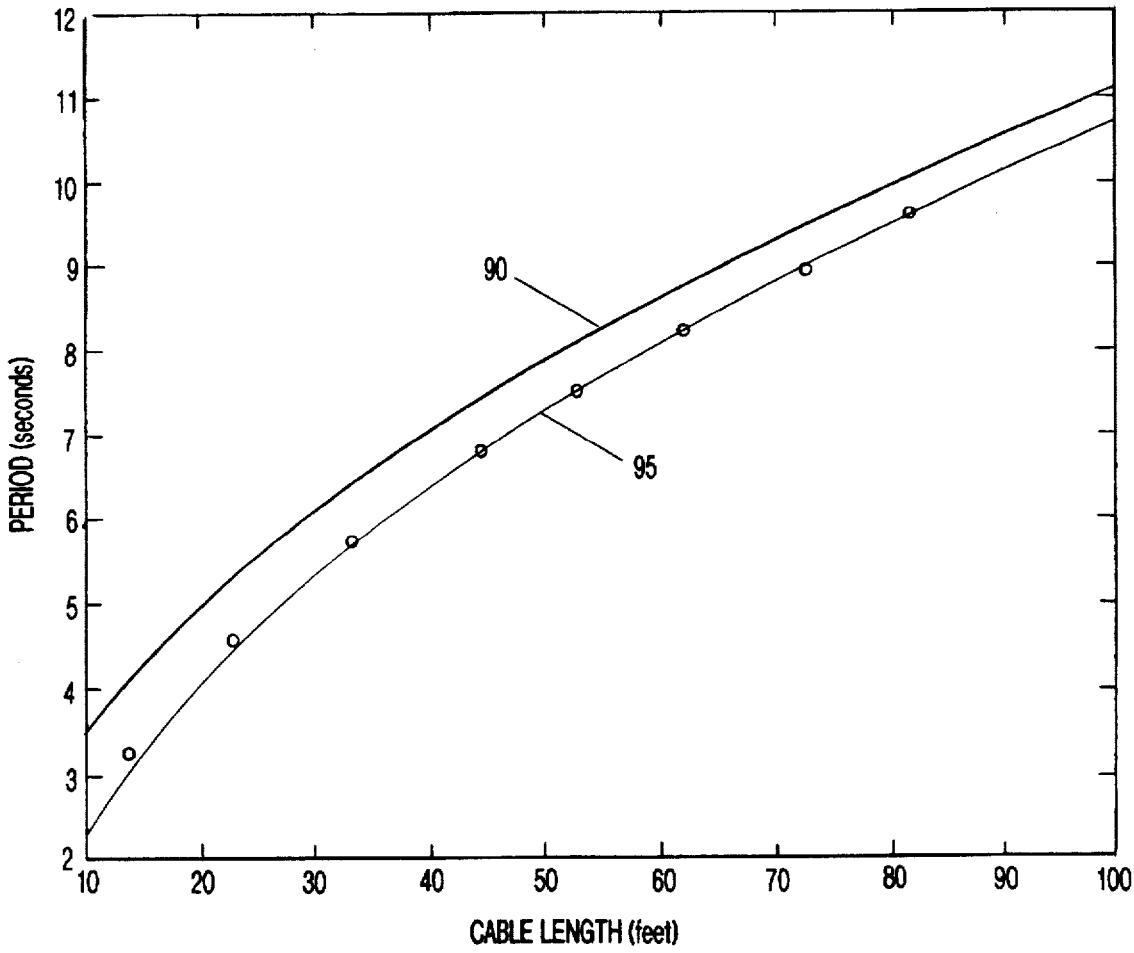
FIG. 8 is a graph of the period in seconds versus the cable length in feet for a simple pendulum model and a quadrilateral model with the spreader and container combined as the payload in accordance with the present invention.

Note that because $$I_z = \frac{m(h^2+w^2)}{12}$$

the mass m term can be removed in the definition of the effective cable length $l_{eff}$ as shown above in Eq. (28). Note also that when dimensions d equals dimension c, then $\delta_0=0$ and $l_{eff}=l$, which implies that the effective cable length $l_{eff}$ equals the measured cable length l, independent of the height h of the payload 30. For this unique case, the system acts like a simple pendulum. However, when dimension d is greater than dimension c, the effective cable length $l_{eff}$ decreases, resulting in a shorter period of oscillation $\tau$ and a higher natural frequency of oscillation $\omega$ as shown in FIG. 8. These results were validated with experimental data on a ship port crane. When dimension d is greater than dimension c and the cable length l is not too long, then the effective cable length $l_{eff}$ is less than cable length l. For example, if d=12, h=w=c=8, and l=13, then $$\delta_o = \frac{d-c}{l} = 0.3076923,$$

for a rotational inertia value of 0.003883 and a point mass value of 0.69714. Therefore, the ratio of $l_{eff}$ to l, i.e., $$\left(\frac{l_{eff}}{l}\right),$$

in this example is 0.701.

Referring to FIG. 8, there is illustrated an example of a graph of the period of oscillation $\tau$ in seconds versus the cable length l in feet for a simple pendulum model 90 and a quadrilateral model 95 with the spreader 20 and container 21 combined as the payload 30. For the graph of FIG. 8, the following values for dimensions h, w, c, and d were used: h=8, w=9, c=3.5, d=6.5, and $$\tau = 2\pi\sqrt{\frac{l}{g}} = \frac{2\pi}{\omega}$$

were used for the simple pendulum model 90, while Eq. (28) for the effective cable length was computer implemented for the quadrilateral model 95. Notice how both models 90 and 95 produce substantially different results.

In an alternate embodiment of the IIR filter, with the aid of FIG. 5, the effective cable length $l_{eff}$ described above, or the effective natural frequency of oscillation $\omega$, are determined by defining the constraints in an alternate manner and linearizing the equations of motion at a different point than in previously-presented embodiment (associated with Eqs.

(20)–(28)) to determine the natural frequency of oscillation $\omega$, and thus, the period of oscillation $\tau$. The following alternate embodiment provides an even more accurate model than the previously-described quadrilateral embodiment, but is more computationally intensive.

With the aid of FIG. 3 or 5, KE and PE for the quadrilateral model illustrated therein, and from which the equations of motion (Eqs. (29)–(33)) are described above (see Eqs. (20)–(21)).

The constrained equations of motion are:

$$0=c\sin(\gamma)+l(\cos(\phi)-\cos(\delta)), \quad \text{Eq. (29)}$$

$$0=(d^2-c^2)+2dl(\sin(\phi)-\sin(\delta))+2l^2(1-\cos(\phi-\delta)), \quad \text{Eq. (30)}$$

$$0=-2l\lambda_1(d\cos(\phi)+l\sin(\phi-\delta))+l\lambda_2\sin(\phi), \quad \text{Eq. (31)}$$

$$0=\left[l+\frac{1}{4}m(c^2+h^2)\ddot{\gamma}\right]+\frac{1}{2}m\ddot{\delta}[cl\sin(\delta-\gamma)+hld\cos(\delta-\gamma)]+\frac{1}{2}m\dot{\delta}^2[lc\cos(\delta-\gamma)-hl\sin(\delta-\gamma)]+mg\left[\frac{c}{2}\cos(\gamma)+\frac{h}{2}\sin(\gamma)\right]+\frac{1}{2}m\ddot{x}[h\cos(\gamma)-c\sin(\gamma)]-c\lambda_2\cos(\gamma). \quad \text{Eq. 32}$$

$$0=ml^2[\text{[illegible]}]\$\ddot{\text{g}}\text{d}+\tfrac{1}{2}m\gamma[cl\sin(\delta-\gamma)+hl\cos(\delta-\gamma)]-\tfrac{1}{2}m\gamma^{-2}[cl\cos(\delta-\gamma)-hl\sin(\delta-\gamma)]++mgl\sin(\delta)+ml\ddot{x}\cos(\delta)+2l\lambda_1[d\cos(\delta)+l\sin(\phi-\delta)]-l\lambda_2\sin(\delta), \quad \text{Eq. (33)}$$

where $\lambda_1$ and $\lambda_2$ are the Lagrange multipliers.

In order to apply an appropriate feedback control scheme to this quadrilateral model, it should first be linearized about an equilibrium state. Linearizing for small $\gamma$ greatly simplifies the equations of motion, i.e., let $\gamma_{NOMINAL}=\gamma=0$ and $$\phi_{NOMINAL}=-\delta_{NOMINAL}=-\delta_N=\left(\sin^{-1}\left(\frac{c-d}{2l}\right)\right)=\phi_N.$$

By linearizing Eqs. (29)–(33) and simplifying the results, the above yields:

$$\omega=\sqrt{\frac{g\left[\cos(\delta_N)+\frac{2lh}{c^2}\sin^2(\delta_N)-\frac{4d}{mg}\lambda_{1N}\sin(\delta_N)\right]-\left[\sin(\delta_N)+\frac{2l}{c}\sin^2(\delta_N)\right]\ddot{x}}{l\left[\cos^2(\delta_N)-\frac{h}{c}\sin(2\delta_N)+\left(\frac{4I_z}{mc^2}+\frac{h^2}{c^2}\right)\sin^2(\delta_N)\right]}}, \quad \text{Eq. (34)}$$

where $$\lambda_{1N}=\lambda_{1NOMINAL}=\frac{(-mg\sin(\delta_N))}{4(d\cos(\delta_N)-l\sin(2\delta_N))},$$

$$I_z=\frac{m(h^2+w^2)}{12}, \text{ and}$$

$\ddot{x}$ is the commanded acceleration in the x direction. Thus, the effective cable length of the crane can be obtained from $$l_{eff}=\frac{g}{\omega^2}.$$

The particular values and configurations discussed in the preceding embodiments can be varied and are cited merely to illustrate certain embodiments of the present invention and are not intended to limit the scope of the present invention. Other variations and modifications of the present invention will be apparent to those of ordinary skill in the art, and it is the intent of the appended claims that such variations and modifications be covered. The particular values and configurations discussed above can be varied and are cited merely to illustrate a particular embodiment of the present invention and are not intended to limit the scope of the invention. It is contemplated that the use of the present invention can involve components having different characteristics as long as the principle, the presentation of a swing-free crane system accounting for multiple, variable-length cables, and employing feedback control, is followed. It is intended that the scope of the present invention be defined by the claims appended hereto.

VI. REFERENCES CITED

The entire disclosure of all references—patents, patent applications, and publications—cited herein are hereby incorporated by reference.

We claim:

1. A system for damping payload sway in a crane having a payload suspended by multiple variable-length cables from a trolley, the trolley being moveable in a horizontal plane the payload being moveable in a vertical plane, the system comprising:

cable length sensor means for providing outputs indicative of the lengths of the multiple variable-length cables;

operator input means for generating input signals;

crane controller means responsive to a control signal, for controlling the velocity and acceleration of the trolley; and filter means, responsive to said input signals and said outputs, for generating a control signal for said crane controller to dampen the payload sway associated with movement of the trolley, said filter means having variable control parameters that are varied by signals applied to said filter.

2. The system of claim 1 further comprising cable angle sensor means for sensing a change in at least one cable swing angle with respect to a vertical plane of the trolley.

3. The system of claim 2 further comprising feedback controller means for compensating for disturbances that are external to the system, wherein said feedback controller means provides feedback to said filter means, the feedback being characterized by the disturbances.

4. The system of claim 1 wherein said filter means is characterized by a discrete time-domain linear state model.

5. The system of claim 1 wherein said filter means is an infinite impulse response filter.

6. The system of claim 5 wherein said infinite impulse response filter is implemented on a general purpose digital computer that is programmed with a difference equation to dampen payload swing.

7. The system of claim 6 wherein the difference equation is characterized by $$y(k)=-a_1y(k-1)-a_2y(k-2)-a_3y(k-3)+b_0u(k)+b_1u(k-1)+b_2u(k-2)+b_3u(k-3)+b_4u(k-4)$$

where y(k) represents the output signals of the infinite impulse response filter at discrete time k, u(k) represents the input signals of the infinite impulse response filter at discrete time k, $a_1$, $a_2$, $a_3$, $b_0$, $b_1$, $b_2$, $b_3$, and $b_4$ represent the variable control parameters.

8. The system of claim 7 wherein variable control parameters $a_1$, $a_2$, $a_3$, $b_0$, $b_1$, $b_2$, $b_3$, and $b_4$ are a function of g, l, $\xi$, $\kappa$, and T, where g is gravity, l is the variable cable length, $\xi$ is a damping ratio characterized by $$\xi = \frac{\dot{l}}{\sqrt{lg}},$$

where $\dot{l}$ is the velocity of the variable cable length, $\kappa$ is a scale factor characterized by $$\kappa = \frac{\sigma}{\omega},$$

where $\sigma$ is a desired time constant and $\omega$ is the natural frequency of oscillation of the suspended payload, and T is a predetermined sampling period.

9. The system of claim 1 wherein said feedback controller means is a proportional integral feedback controller.

10. The system of claim 1 wherein the variable control parameters are modified based on the length of the variable length cables.

11. The system of claim 10, wherein the variable control parameters are modified based on the height of a payload.

12. The system of claim 1 wherein the control signals are a function of the input signals.

13. The system of claim 1 wherein the variable control parameters are updated real time.

14. The system of claim 1 wherein the system is subject to a fixed control interval.

15. A method for damping payload sway in a crane having a payload suspended by multiple variable-length cables from a trolley, the trolley being moveable in a horizontal plane, comprising the steps of:

moving the trolley via input signals from an operator input device;

providing filter means for receiving the input signals from the operator input device, the filter means being characterized by variable control parameters that can be updated;

determining a variable cable length;

determining the natural frequency of oscillation $\omega$, updating the variable control parameters of the filter means;

changing the input signals of the filter means to output signals, the output signals being a function of the input signals and the variable control parameters; and sending the output signals to a crane controller to damp payload sway.

16. The method of claim 15 further comprising the steps of:

providing at least one estimated cable swing angle; and measuring at least one actual cable swing angle with a cable angle sensor determining a cable swing angle error from the at least one estimated cable swing angle and the at least one actual cable swing angle; and continuously feeding back to feedback controller means the cable swing angle error.

17. The method of claim 16 further comprising the step of combining the cable swing angle error with the output signals.

18. The method of claim 16 further comprising the step of continuously feeding back external disturbances to the filter means.

19. The method of claim 15 wherein said step of updating the variable control parameters of the filter means includes a natural frequency of oscillation $\omega$.

20. The method of claim 19 wherein the natural frequency of oscillation $\omega$ is characterized by $$\omega = \sqrt{\frac{g}{l}},$$

where g is gravity and l is the length of the variable cable length.

21. The method of claim 19 wherein the natural frequency of oscillation $\omega$ is characterized by $$\omega = \sqrt{\frac{g}{l_{eff}}},$$

where g is gravity and $l_{eff}$ is the effective cable length of the variable cable length.

22. The method of claim 21 wherein $l_{eff}$ is a function of payload width, payload height, cable swing angle, trolley pulley distance, and variable cable length.

23. The method of claim 22 wherein $l_{eff}$ is characterized by $$l_{eff} = l\left\{0.5\left[1+\frac{w^2}{c^2}+\left(1-\frac{w^2}{c^2}\right)\cos(\delta_0)-2\frac{w}{c}\sin(\delta_0)\right]+\frac{l^2(h^2+w^2)}{3c^4}(1-\cos(\delta_0))^2\right\},$$

where h is the height of the payload, w is the width of the payload, c is the distance between a set of spreader pulleys, and $$\delta_o = \frac{d-c}{l},$$

where d is the distance between a set of trolley pulleys.

24. The method of claim 19 wherein the natural frequency of oscillation $\omega$ is a function of gravity, payload mass, payload height, payload width, cable swing angle, spreader pulley distance, trolley pulley distance, and variable cable length.

25. The method of claim 24 wherein the natural frequency of oscillation $\omega$ is characterized by $$\omega = \sqrt{\frac{g\left[\cos(\delta_N)+\frac{2lh}{c^2}\sin^2(\delta_N)-\frac{4d}{mg}\lambda_{1N}\sin(\delta_N)\right]-\left[\sin(\delta_N)+\frac{2l}{c}\sin^2(\delta_N)\right]\ddot{x}}{l\left[\cos^2(\delta_N)-\frac{h}{c}\sin(2\delta_N)+\left(\frac{4I_Z}{mc^2}+\frac{h^2}{c^2}\right)\sin^2(\delta_N)\right]}},$$

where $$\delta_N = -\left(\sin^{-1}\left(\frac{c-d}{2l}\right)\right),$$

where c is a distance between a set of spreader pulleys, d is a distance between a set of trolley pulleys, $$\lambda_{1N} = \frac{(-mg\sin(\delta_N))}{4(d\cos(\delta_N) - l\sin(2\delta_N))},$$

where m is the mass of the payload, g is gravity, $I_z$ is the mass moment of inertia characterized by $$I_z = \frac{m(h^2 + w^2)}{12},$$

where h is the height of the payload, w is the width of the payload, and $\ddot{x}$ is the commanded acceleration in the horizontal plane of the trolley.

26. The method of claim 15 wherein said step of updating the variable control parameters of the filter means includes a damping ratio $\xi$, wherein the damping ratio $\xi$ is characterized by $$\xi = \frac{\dot{l}}{\sqrt{lg}},$$

where g is gravity, l is the cable length, and $\dot{l}$ is the velocity of the variable cable length.

27. The method of claim 15 wherein the filter means controls motion of the trolley, the filter means being subject to a settling time, the settling time being a function of a scale factor $\kappa$, the scale factor $\kappa$ being characterized by $\kappa=\sigma/\omega$, where $\sigma$ is a desired time constant and $\omega$ is a natural frequency of oscillation of the suspended payload.

* * * * *